US006550967B2

(12) United States Patent
Hedaya

(10) Patent No.: US 6,550,967 B2
(45) Date of Patent: Apr. 22, 2003

(54) BAG STUFFER

(75) Inventor: Maurice Hedaya, Brooklyn, NY (US)

(73) Assignee: Barclay Brown Corp., Brooklyn, NY (US)

( * ) Notice: Subject to any disclaimer, the term of this patent is extended or adjusted under 35 U.S.C. 154(b) by 0 days.

(21) Appl. No.: 09/768,882

(22) Filed: Jan. 24, 2001

(65) Prior Publication Data

US 2002/0095915 A1 Jul. 25, 2002

(51) Int. Cl.[7] ..... B65D 30/00
(52) U.S. Cl. ..... 383/127; 53/570
(58) Field of Search ..... 53/390, 384.1, 53/382.1, 382.2, 382.3, 381.1, 570; 383/34, 34.1, 127; 150/144, 900; 190/107, 36, 106

(56) References Cited

U.S. PATENT DOCUMENTS 2,795,259 A * 6/1957 Nash ..... 150/152
2,819,749 A * 1/1958 Renz et al. ..... 190/106
4,141,399 A * 2/1979 Zoland ..... 190/106
5,259,674 A * 11/1993 Hedaya et al. ..... 383/127
5,476,184 A * 12/1995 Hill ..... 190/107
5,542,767 A * 8/1996 Hedaya et al. ..... 383/127
5,747,709 A * 5/1998 Oshikubo ..... 222/287

* cited by examiner

*Primary Examiner*—Stephen F. Gerrity
*Assistant Examiner*—Christopher Harmon
(74) *Attorney, Agent, or Firm*—Notaro & Michalos P.C.

(57) ABSTRACT

A bag stuffer for an expandable bag has an insert that is movable from a collapsed orientation for enabling compact storage of an expandable bag containing the insert, to an expanded orientation for providing a commercial display of an expandable bag containing the insert. The insert includes one or two substantially rigid and substantially planar side panels and a bottom panel having opposite ends. The one or two side panels are connected to one or both of the opposite ends of the bottom panel at a hinge area containing a fold between the sides panels and the bottom panel. A biasing torsion spring, memory plastic at the hinge areas or leaf spring biases the insert toward the expanded orientation, the biasing force being applied in the hinge area for directly acting on the fold to bias the side panels away from the bottom panel and toward the expanded orientation. One or more releasable restraining straps about the insert is adapted to be disposed at least partially within the expandable bag containing the insert, for restraining movement of the insert from the collapsed orientation to the expanded orientation.

4 Claims, 8 Drawing Sheets

BAG STUFFER

FIELD AND BACKGROUND OF THE INVENTION

The present invention relates to a bag stuffer having an insert movable from a collapsed orientation, which enables compact storage of an expandable bag containing the insert, to an expanded orientation, which provides a commercial display of the expandable bag containing the insert.

Bag stuffers or expanders are well-known in the retail art. Each bag stuffer includes an insert which is movable from a collapsed orientation, which enables compact storage of an expandable bag containing the insert for shipping and retail storage purposes, to an expanded orientation, which provides a commercial display of an expandable bag containing the insert. Bag stuffers are used with a wide variety of expandable articles which, for reasons of economy, are preferably shipped and stored in a relatively flat or collapsed orientation, but are best presented in commercial displays in an expanded orientation. Such articles include backpacks, baseball bags, basketball bags, belt bags, briefcases, cooler bags, cosmetic kits, cross trainer bags, duffle bags, Dop kits, bowling bags, fashion totes, hand bags, locker bags, lunch bags, pilot cases, purses, roller skating bags, snorkeling bags, soft-sided luggage, sports bags, sportsman's gear bags, tackle bags, tennis bags, utility bags, and the like. The present invention can be used to stuff any of these bags and any other soft bags not specifically listed, as well.

Initially the function of the bag stuffer was performed by cardboard forms or crushed paper which had to be inserted by the retailer after receipt of the collapsed article from the manufacturer. Indeed, some bag stuffers still require the retailer to insert his hand or an instrument into the collapsed article to activate the bag stuffer—that is, to move the insert from its collapsed orientation to its expanded orientation. However the modern bag stuffers typically include means for biasing the insert to the expanded orientation, and releasable restraining means which are disposed about the insert in the collapsed orientation for restraining movement of the insert from the collapsed orientation to the expanded orientation.

In its simplest form, the restraining means may be disposed about the outside of the expandable bag containing the insert so that the retailer has only to cut or otherwise disable the restraining means in order to activate the insert. This is generally not an acceptable situation as the restraining means (or the article used to cut or disable the restraining means) may mar the exterior surface of the bag, thereby rendering it unsaleable. Accordingly, most modern restraining means are disposed about the insert and within the expandable bag containing the insert, so that the restraining means cannot mar the exterior surface of the bag.

A further disadvantage of the known bag stuffers is the requirement that the ends of the biasing means (which is typically a coil spring) must be secured to the planar elements or panels of the insert against which they bear by adhesive or the like. The use of adhesive is typically messy and time consuming (as the adhesive must be given an opportunity to dry before it is subjected to forces which may result in relative movement of the spring and the panel), and therefore expensive. While non-adhesive techniques exist for securing the spring ends and planar elements of the insert together, these typically involve expensive and/or compound mechanisms. Accordingly, the need remains for a bag stuffer wherein the ends of the biasing means are directly secured to the planar elements without adhesives and without expensive and/or compound mechanisms.

A further disadvantage of the known bag stuffers is the limitations on the configurations of the expandable bags with which they are useful. Thus while the known bag stuffers are typically useful with relatively shallow, generally rectangular bags, the various planar elements of the insert which abut the bag and are used to force the bag to its expanded orientation could not be used in connection with cylindrical or duffel-type bags or other bags not having parallel sides. Additionally, even where the bag has parallel sides, the biasing means typically cannot separate the planar elements by more than a given distance (determined by the length of the coil spring biasing means) unless an intermediate panel or flap is used (with the biasing means acting on the flap which in turn separates the planar elements). Accordingly, the need remains for a bag stuffer which can expand unusually shaped bags and which, without the presence of intermediate elements (such as flaps), permits the biasing means to move the planar elements abutting the bag to a desired separation greater than the length of the biasing means.

The inventor of the present invention has contributed to this field in U.S. Pat. Nos. 5,542,767 and 5,259,674 which are incorporated here by reference. Both disclose the use of springs to deploy panels of a bag expander or stuffer.

A need still remains, however, for a bag stuffer of increased efficience and reduced cost and complexity for the luggage industry and related fields.

SUMMARY OF THE INVENTION

An object of the present invention is to provide a bag stuffer which is safe to use, simple and inexpensive to manufacture and deploy.

Another object is to provide a bag stuffer where the ends of the biasing means can be directly secured to the insert planar elements without adhesives and without expensive and/or compound mechanisms.

A further object is to provide a bag stuffer which permits the biasing means to move the planar elements abutting the bag to a desired separation greater than the length of the biasing means without the presence of intermediate elements such as flaps.

It is also an object of the present invention to provide a bag stuffer which, in one embodiment, is useful with non-rectangular bags.

It has been found that the above and related objects of the present invention are obtained in a bag stuffer for an expandable bag. The bag stuffer comprises insert means, biasing means and restraining means. In its conventional aspects, the insert means is movable from a collapsed orientation for enabling compact storage of an expandable bag containing the insert means to an expanded orientation for providing a commercial display of an expandable bag containing the insert means. In their conventional aspects, the biasing means is for biasing the insert means to the expanded orientation, and the releasable restraining means, disposed about the insert means and at least partially within an expandable bag containing the insert means, is for restraining movement of the insert means from the collapsed orientation to the expanded orientation.

According to one embodiment of the present invention, the restraining means comprises one or more loops of a flexible strap formed by heat sealing one end of the strap to a strap portion adjacent the other end of the strap at at least one point to define a rupturable heat-seal bond. In a preferred embodiment for the restraining means, one or more heat-seal bonds are used, the number and size and strength of the heat-seal bonds being selected to render the loop strong enough to maintain the insert means in the collapsed orientation against the biasing of the biasing means yet weak enough to enable easy intentional manual rupture thereof. Preferably the restraining means use a plurality of the heat-seal bonds disposed along an axis extending generally transverse to the length of the strap. The other end of the strap extends externally of an expandable bag containing the insert means, thereby to enable intentional manual rupture of the loop from outside of the expandable bag. The restraining means is preferably polypropylene tape.

According to another embodiment of the present invention where the insert means included substantially rigid, substantially planar elements or panels that are connected to each other at hinge areas, the biasing means comprises a coiled torsion spring, a leaf spring or other spring means near each hinge area of the insert means.

According to certain preferred embodiments of the invention, the biasing means are torsion springs or U-shaped leaf springs at each hinge area. The ends of the torsion respectively engages panels on opposite sides of the hinge. A flat central portion of each leaf spring is placed outside the hinge area which is simply a fold line in the insert material between the panels. L-shaped end portions at each end of the central portion of each leaf spring, extend through openings on opposite sides of each fold line. This simply and efficiently locks the springs in place without glue or other structure, and caused the springs to act immediately at the hinge area on the fold lines to open the panels. This local action of all the spring means of the invention immediately in the hinge areas, amoung other things, distinguishes the present invention over the prior art.

Where corrugated cardboard is used as the panel material, the corrugations extend parallel to the serial connection of the panels to each other. This is also transverse to the fold lines forming the hinge areas between the panel. When leaf springs are used as the biasing means, the flat areas of the L-shaped end portions of the springs lie flat against the inner surfaces of the cardboard and find a strong wear-resistant area to apply the spring form to the insert to open the panels, without damaging the cardboard material.

In another embodiment of the invention, the torsion springs are replaced by resilient "live" hinges forming the hinge areas between the panels which tend to bias the panels toward their open or deployed position naturally when restraining means that hold the panels in their closed, collapsed or insert position, are released. This opening force, again is applied directly in the hinge area as with the other embodiments of the invention.

These live hinges are achieved by making the panels as well as the hinges between the panels, of material, preferably plastic material such as polypropylene, which has an inherent resilience or "memory" and tends to return to its open or unfolded state when the holding pressure of the restraining means is removed.

Other features of the invention include cardboard or plastic blanks which can be folded to form the bag stuffers of the present invention.

Although certain preferred embodiments of the invention include a bottom panel and a pair of opposite side panels, which are either folded to the same side of the bottom panel or to opposite sides of the bottom panel to form a Z-shape, the invention operates just as well for certain types of bags with a bottom panel and only a single side panel to form an L-shaped insert.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
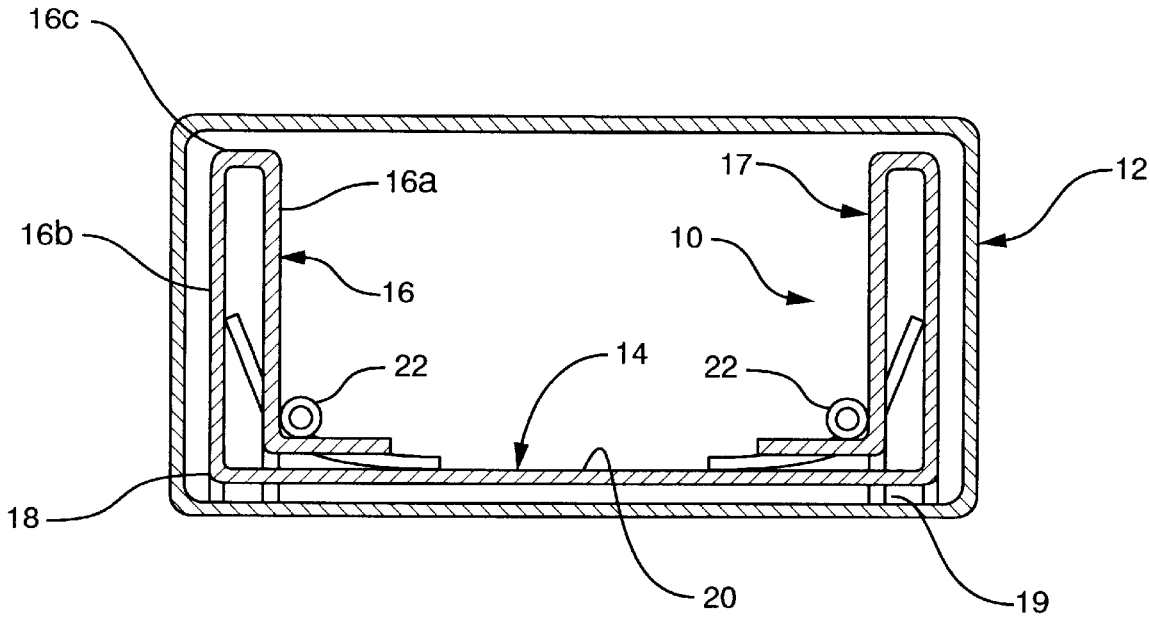
FIG. 1 is a side sectional view of one embodiment of the bag stuffer of the invention, in its expanded orientation or position inside an expandable bag.
Figure 2:
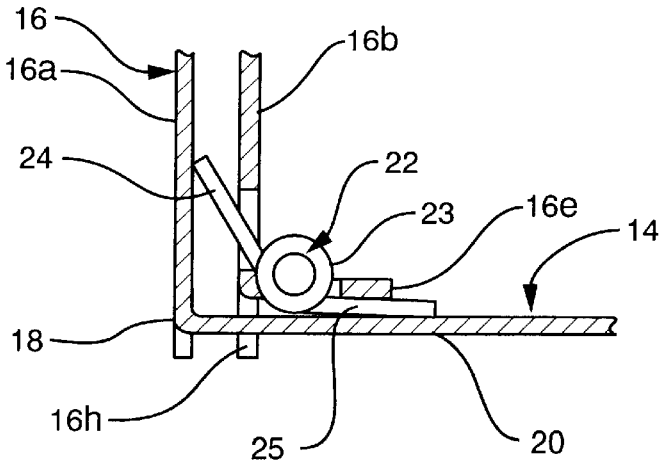
FIG. 2 is an enlarged detail of FIG. 1 near one of the hinge areas of the bag stuffer.
Figure 3:
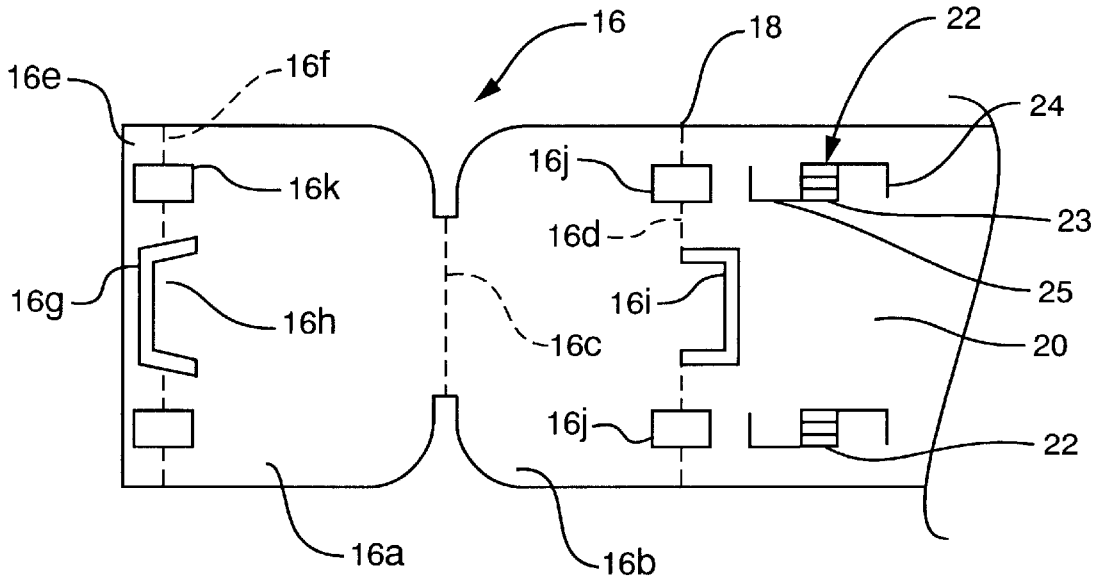
FIG. 3 is a partial top plan and exploded view of a cardboard blank with torsion springs for making the bag stuffer of FIG. 1.

Referring to the drawings in which like reference numerals are used to refer to the same or functionally similar elements, the invention embodied therein, a FIGS. 1, 2 and 3, is a first embodiment of a bag stuffer generally designated 10 in an expanded or open orientation or position and disposed in an expanded expandable bag generally designated 12. The expandable bag 12 may be soft-sided luggage, a purse, a cosmetic kit, a Dop kit, a briefcase, a backpack or any other type of soft bag and, as illustrated in FIG. 1, is of a generally, but not necessarily, rectangular right angle parallelepiped or box-like configuration. As will be explained in connection with other embodiments of the present invention, the bag may be of cylindrical, trapezoidal, irregular or of any other configuration.

Figure 9:
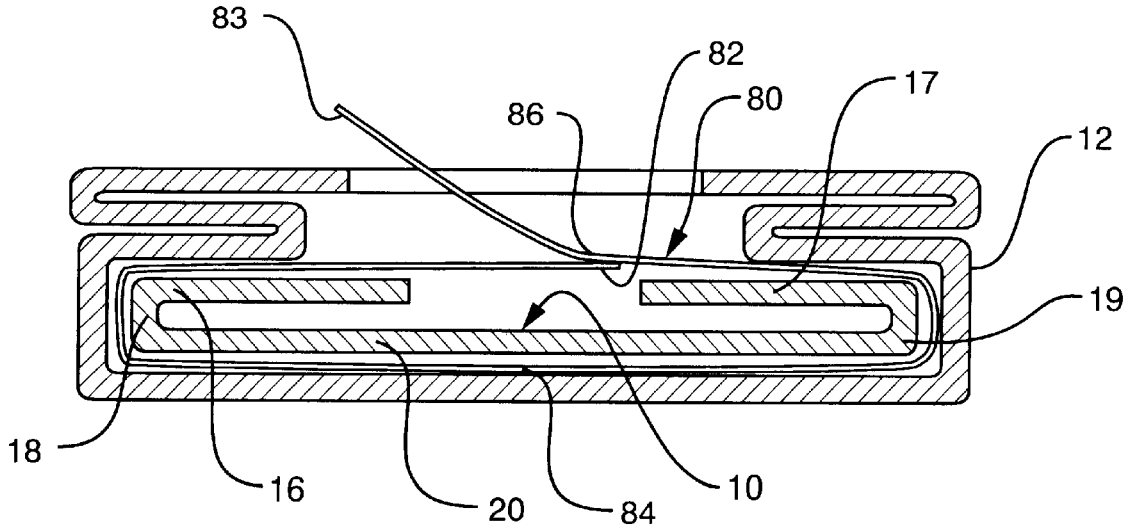
FIG. 9 is a side sectional view of another embodiment of the invention which used resilient "live" hinges as spring means for opening the bag stuffer into its expanded orientation.

It will be appreciated by those familiar with the bag stuffer art that the soft portions of the bag 12 which can be folded down to a collapsed position for storage and transport, are typically randomly crumpled and not folded in a neat and orderly manner as shown in FIG. 9, for example. For the present invention it is sufficient for the bag to have an area inside, usually at the bottom of the bag, which can receive the bag stuffer of the present invention in its collapsed or closed orientation, which is also illustrated in FIG. 9.

Returning to FIGS. 1, 2 and 3, the bag stuffer 10 comprises an insert or insert means, generally designated 14, movable from a collapsed orientation enabling compact storage and shipping of the expandable bag 12 containing the insert 14 and to an expanded orientation (FIG. 1) providing a commercial display of the expandable bag 12 containing the insert expanded 14. In the embodiment of the bag stuffer 10 in FIG. 1, the insert comprises a parallel pair of substantially planar, substantially rigid end elements or panels 16 and 17, which are connected at hinges or hinge areas 18 and 19, to the opposite ends of a base element or panel 20.

Figure 15:
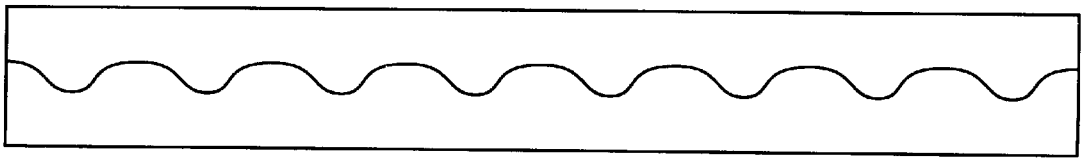

The elements or panels 16, 17 and 20 are preferably formed of one or more sheets of paperboard, e.g. corrugated cardboard like that illustrated in FIG. 15, having edges that are softer than the interior surface of the bag 12 so that they do not mar the bag.

The bag stuffer 10 additionally includes biasing means positioned immediately at each hinge or hinge area 18,19, for biasing the insert 14, and in particular the planar elements 16 and 17, from their collapsed orientation where the side element 16,17 lie flat down on top of and parallel to the top surface of bottom panel 20, like the position shown in FIG. 9, to the expanded orientation illustrated in FIG. 1.

As illustrated in FIGS. 1, 2 and 3 there are four biasing means 22 provided for the insert 14, two for biasing each side panel 16,17 with respect to the bottom panel 20, toward the expanded position of FIG. 1. Each biasing means in the embodiment of FIG. 1, is a torsion spring 22 having a plurality of coils in a central coil area 23, and opposite tangential ends 24 and 25 extending from opposite sides of the coil area.

Figure 4:
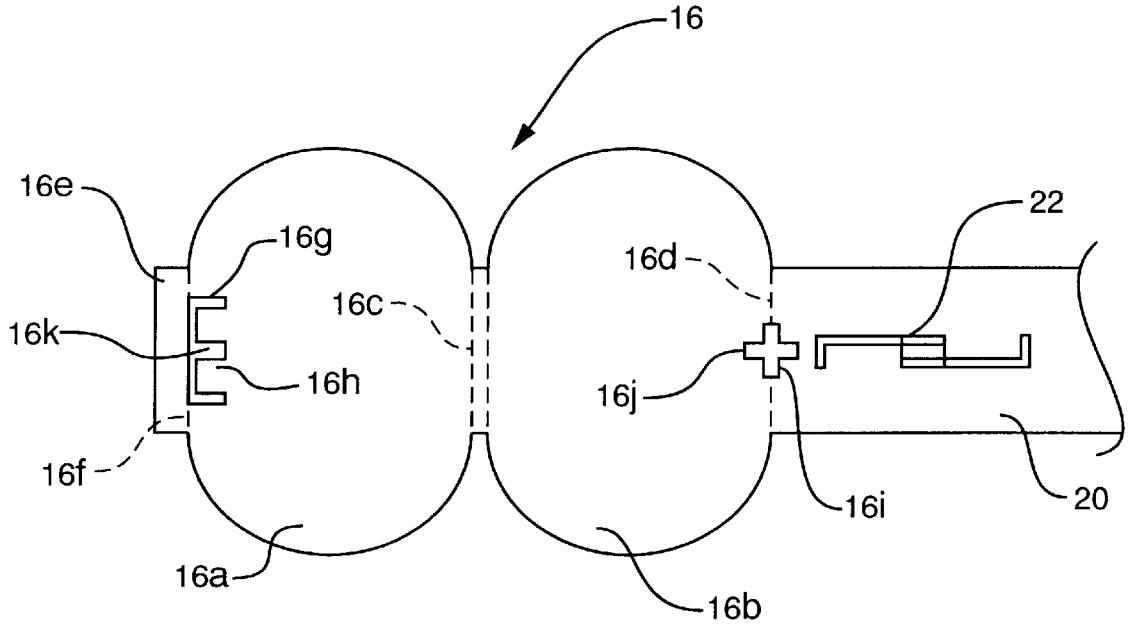
FIG. 4 is a view similar to FIG. 3 but of another embodiment of the invention and including a torsion spring located in preparation for an initial assembly step for making a bag stuffer according to the present invention.

Depending on the lengths of the planar elements 16,17, it may be desirable to use a single biasing means 22 (typically connecting the center points of the planar elements 16,17 as in the embodiment of FIG. 4), two biasing means (as illustrated in FIGS. 1–3) or even a greater number of equidistantly spaced apart biasing means 22. As with every embodiment of the invention the biasing means are immediately in the hinge areas and directly act on portions of the panels that are near the folds forming the hinge areas.

Figure 5:
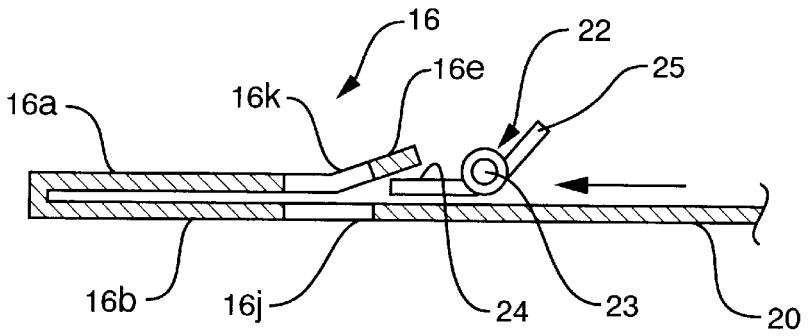
FIG. 5 is a partial, side sectional view of the bag stuffer of FIG. 4, showing a further step in the assembly process.
Figure 6:
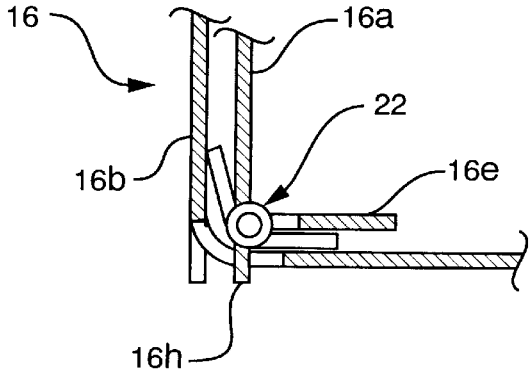
FIG. 6 is a view similar to FIG. 5 but showing a detail of the hinge during a still further assembly step.

The side panel 16 in FIGS. 1–6 each comprise a first and a second panel portion 16*a* and 16*b* which are parts of a cardboard blank best shown in FIGS. 3 and 4. The panel portions are connected to each other at a top fold or pair of parallel closely spaced top folds 16*c*, and the shape of the panel portions match each other and are selected to match the shape of end panels of the expandable bag to be stuffed. The second panel portion 16*b* is connected to the bottom panel 20 at a bottom fold 16*d*. An end panel portion 16*e* is connected to the outer end of panel portion 16*a* by an end fold 16*f*. A U-shaped slot 16*g* is cut in panel portion 16*e* near fold 16*f* to form a tab 16*h* which is positioned to stay flat when the material of the insert is bent at end fold 16*f*. A further slot 16*i* is cut near fold 16*d* at a location to receive tab 16*h* when the material is folded at top fold(s) 16*c* and bottom fold 16*d* so that panel portions 16*a*, 16*b* are brought next to each other (FIG. 5) and into an upright position (FIGS. 1, 2 and 6).

FIG. 5 illustrates an intermediate step during the assembly process when panel portions 16*a*, 16*b* are still flat and parallel to bottom panel 20. At this stage, spring 22 is slid with its end 24 between the panel portions 16*a*, 16*b* and its coil portion 23 is moved into an opening 16*k* which had been cut at fold 16*f* (see FIGS. 3 and 4). This is done by lifting end panel 16*e* slightly. Another opening 16*j* is cut at fold 16*d* and overlaps opening 16*k* when the panel portions are folded (e.g. FIG. 6).

The openings 16*j*, 16*k* function to hold the springs 22 in position at each fold 18 that is formed by the top and bottom folds 16*c*, 16*d* separating the panel portions. Openings 16*j*, 16*k* cause the coil portion 23 to be inside the fold 16*f* and between the end panel 16*e* and the first panel portion 16*a*. This has been found to enhance the opening force exerted by the spring on the side panel. Opening 16*j* allows some freedom of motion for the spring in the hinge area as well. Tab 16*h* in slot 16*i* fixes the panel portions to each other and helps define the hinge area 18. The tab also helps hold the side panel 16 in an upright position for the expanded orientation of FIG. 1, by limiting the pivoting of hinge 18 beyond 90°.

Side panel 17 is manufactured and assembled in the same manner as side panel 16 for the embodiments of FIGS. 1–6.

The embodiment of FIG. 4 has substantially circular side panels for a cylindrical expandable bag while the embodiment in FIG. 3 has side panel for a rectangular bag.

In the embodiments of FIGS. 1–6 and in the later to be described embodiments of FIGS. 16–20, the present invention can be practiced with a bottom panel and a single side panel connected at a hinge to the bottom panel and with biasing means at the hinge to expand the insert means. This is useful for bags which do not have symmetrical opposite sides, for example, triangular bags or other bags which can be adequately expanded with only two panels as shown, for example, in FIG. 21. Any of the biasing means shown throughout this disclosure can be used for this two panel construction.

Figure 7:
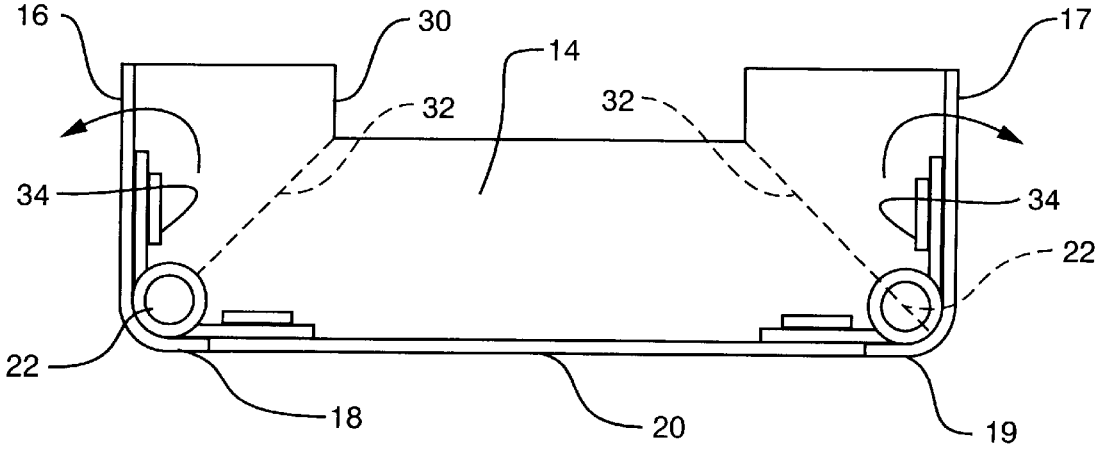
FIG. 7 is a side sectional view of a still further embodiment of the bag stuffer of the present invention.
Figure 8:
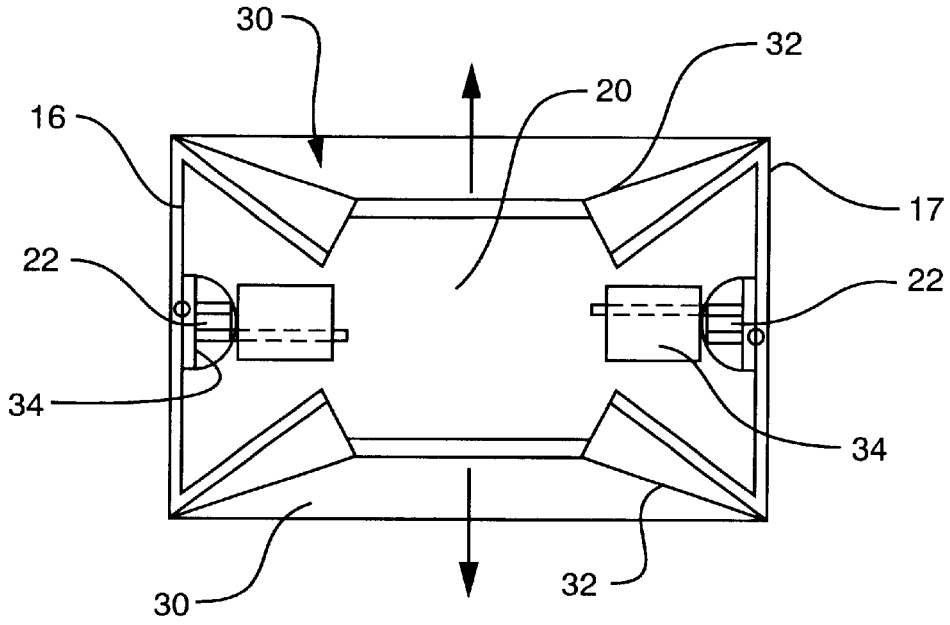
FIG. 8 is a top plan view of the embodiment of FIG. 7, in an intermediate position between a fully collapsed orientation for storage and for insertion of the bag stuffer into a bag, and a fully expanded orientation for expanding the bag.

FIGS. 7 and 8 illustrate an embodiment of the invention which utilizes single-thicknesses of cardboard material to form side panels 16, 17. The biasing means are still one or more torsion springs 22 which are confined to the hinge areas 18, 19. Springs 22 act at the folds forming the hinge areas 18, 19 to open the side panels 16, 17 in the direction of the curved arrows in FIG. 7. Insert 14 in FIGS. 7 and 8 also includes front and back panels generally designated 30, each containing a pair of angled folds 32 which allow the sides 30 to collapse toward each other as the side panels 16, 17 are folded down against the direction of the curved arrows in FIG. 7 and against the biasing force of springs 22. Cover boards 34 are glued to the inside surfaces of panels 16, 17 and 20 to cover the ends of torsion spring 22 but still allow some axial movement of the ends to allow easy pivoting of the inside panels 16, 17. The front and rear panels 30 also limit the outward opening of side panels 16, 17 so that they form a rectangular orientation in their expanded or open orientation.

FIG. 9 illustrates an embodiment of the invention where panels 16, 17 are connected to bottom panel 20 by "live" hinges that are made of the same material as the panels, for example, resilient plastic such as polypropylene. This material is known to have a "memory" and to try and return to its original shape after it has been folded. If hinges 18 and 19 are cast in a position where side panels 16 and 17 are perpendicular to or coextensive with bottom panel 20, panels 16 and 17 will tend to return to their upright positions when they are released. FIG. 9 shows the panels in the collapsed orientation being held by restraining means within the collapsed expandable bag 12.

FIGS. 10–15 illustrate different types of materials that can be used to make the embodiments of the invention.

Figure 10:
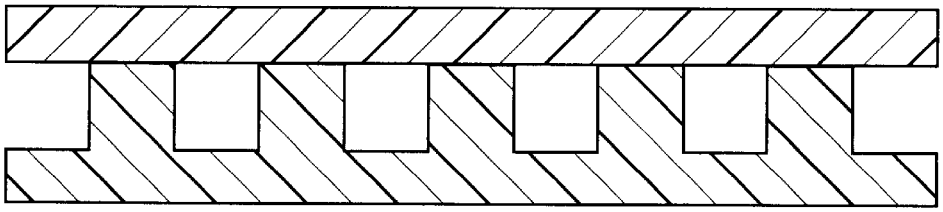
FIGS. 10 to 15 are enlarges side sectional views of various types of sheet material that can be used for making the bag stuffers of the present invention.
Figure 11:
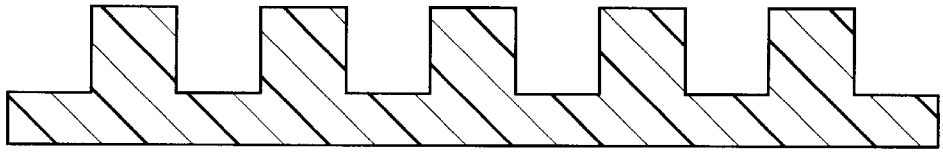
Figure 12:
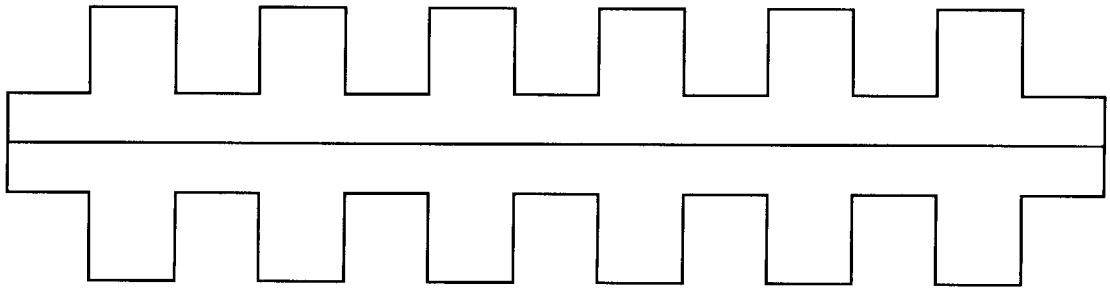
Figure 13:
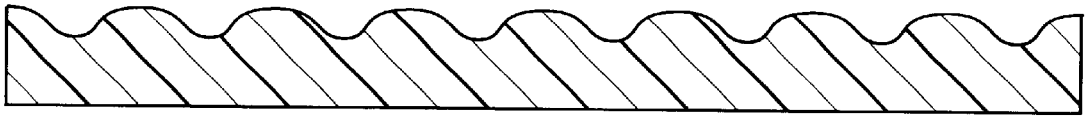

The single sheet of material in the embodiment of FIG. 9 can be produced by extruding single or multiple sheets of plastic with or without indentations or waves on one or both surfaces. FIG. 10 shows an embodiment of plastic material having open square cross-sectioned, elongated channels within its structure that are covered by another flat sheet of material and glue or fused together. FIG. 11 shows similar material that is of only a single thickness of plastic that has been formed with channels. FIG. 12 shows an embodiment using a pair of the sheet materials of FIG. 11, glued or otherwise bonded to each other in a back-to-back fashion. FIG. 13 shows another type of plastic material which is available which has one plainer surface and one undulating surface.

The undulations in FIG. 13 and the channel or cuts in FIGS. 10–12 enhance the strength of the material at least in one direction, preferably transverse to the hinge areas and parallel to the serial connect of panel 16,20,17.

Figure 14:
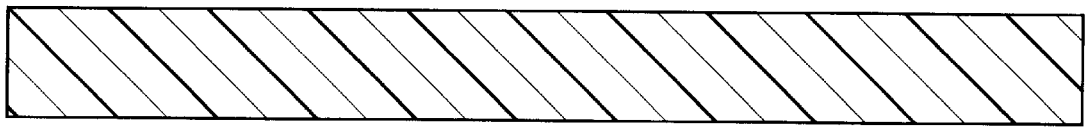

If the materials are sufficiently thick or rigid, however, sheet material having simple planar top and bottom surfaces as shown in FIG. 14 can be utilized.

In other embodiments in the invention, cardboard made of two sheets of lining material on the top and the bottom and a glued corrugated layer therebetween in the form of conventional cardboard can be utilized. Here the corrugations lie parallel to the serial connection of the panels and transverse to the hinge areas.

FIG. 9 also illustrates releasable restraining means generally designated 80 that can be used for each embodiment of the invention. These restraining means are disposed about the bag stuffer 10 to hold it in its collapsed orientation and are at least partially within the expandable bag 12, for restraining movement of the panels of the insert from the collapsed orientation to the expanded orientation. The restraining means 80 preferably comprises a flexible plastic strap with ends 82,83 and a loop 84 formed by heat sealing one end 82 of the strap to a strap portion adjacent the other end 83, at at least one point 86 thereby to define a rupturable heat-seal bond at that point. Typically, the restraining means 80 defines a plurality of the heat-seal bonds 86, the number, size and strength of the heat-seal bonds 86 being selected to render the loop 84 strong enough to maintain the insert panels in their collapsed orientation against the biasing of the biasing means, yet weak enough to enable easy intentional manual rupture thereof. Preferably the restraining means 80 define a plurality of the heat-seal bonds 86 extending generally parallel to the length of the strap. The restraining means loop 84 may extend longitudinally or transversely of the insert as desired for a particular application and insert size. More than one loop 84 may be employed as well.

The strap may be heat-sealable along the entire length thereof and on both surfaces thereof. However, for reasons of economy, the restraining means is optionally made heat-sealable (for example, by application of a coating thereto) only at selected portions along the lengths of one or both surfaces thereof, as necessary to enable the strap to form a loop by heat-sealing. A variety of heat-sealable flexible straps are well-known in the art and any of these offering the proper balance of strength and weakness for the purpose of the present invention may be used herein. A preferred heat-sealable strap is formed from polypropylene tape.

The free end 83 of the restraining means 80 extends externally of the expandable bag 12 containing the insert, to enable intentional manual rupture of the loop from outside of the expandable bag 12.

Preferably the free end 83 of the restraining means exits the expandable bag at an angle which facilitates rupture of the heat-seal bonds 86 when the free end 83 is pulled by hand from outside the closed bag 12. The biasing means at the hinge area of the insert are now free to push the side panels up and away from the bottom panel to expand the bag. If side panels having a shape matching the sides of the bag are used then the bag will appear to be full and attractively shaped for display.

FIGS. 16–19 illustrate a still further, and perhaps preferred embodiment of the invention.

Figure 16:
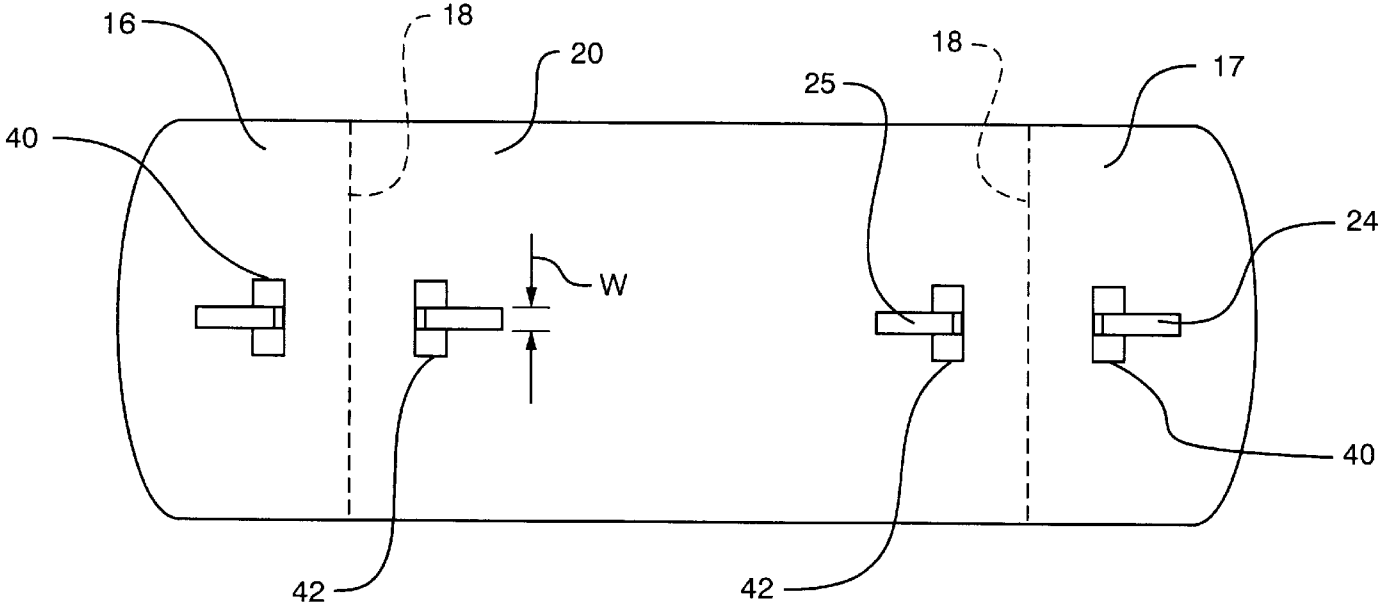
FIG. 16 is a top plan view of an still further embodiment of the invention which uses bent leaf springs as the biasing means.
Figure 17:
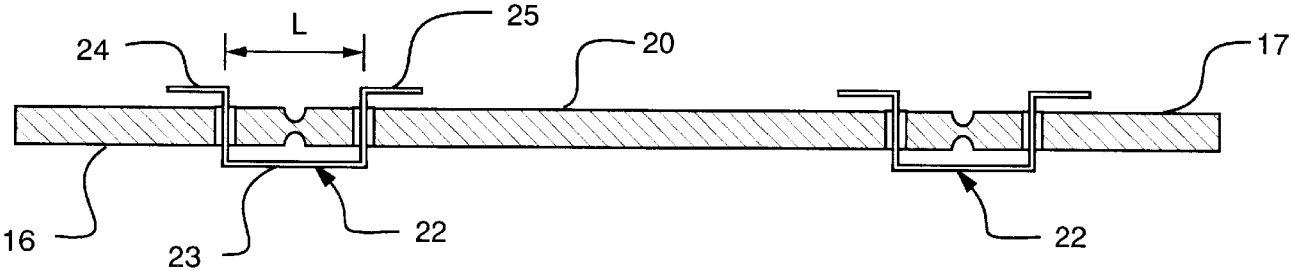
FIG. 17 is a side sectional view of the embodiment of FIG. 16.

In FIG. 16, the bag stuffer comprises an insert movable from a collapsed orientation (FIG. 19) for enabling compact storage of an expandable bag containing said insert means, to an expanded orientation (FIG. 18) for providing a commercial display of an expandable bag 12 containing said insert. The insert comprises a pair of substantially rigid and substantially planar side panels 16,17 and a bottom panel 20, having opposite ends. The side panels are each connected to one of the opposite ends of the bottom panel 20 at a hinge area 18, 18 containing a fold between the sides panels and the bottom panel. Biasing means for biasing the insert toward the expanded orientation, are disposed in the hinge areas for directly acting on the folds to bias the side panels away from the bottom panel and toward the expanded orientation. The biasing means each comprise at least one U-shaped leaf spring 22, the leaf spring having a central portion 23 lying outside each hinge area 18, and a pair of L-shaped end portions 24,26 on opposite sides of the central portion, each L-shaped portion extending through a panel 16, 20 or 17, and being on one side of a fold forming the hinge area.

For this purpose, the insert has pairs of aligned openings 40, 42 therethrough, adjacent and on opposite sides of each fold 18, each opening being rectangular for receiving one of the L-shaped end portions 24, 25 of one of the leaf springs 22. Spring 22 is of spring steel or the like.

The panels of the insert of FIG. 16 are each made of corrugated cardboard having corrugations that extend transversely to the folds forming the hinge areas.

Figure 18:
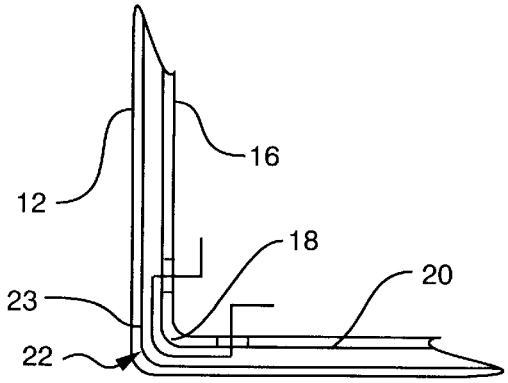
FIG. 18 is a partial side elevational view of the embodiment of FIG. 16 in its expanded orientation or position in a bag.

As shown in FIG. 18, in the expanded position the central portions 23 of the springs 22 are on the outside of the folds 18 and form a curved leaf for holding the side panels open. The L-shaped end portions 24, 25 extending through the openings 40, 42 lie flat against the inner surfaces of panels 16 and 20 thus avoiding damage to the cardboard material and still exerting substantial force against the panels.

Figure 19:
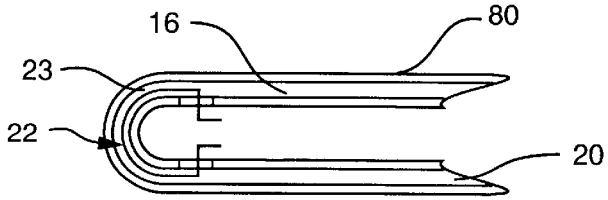
FIG. 19 is a view similar to FIG. 18 of the insert bag stuffer in its closed or collapsed position or orientation.

In FIG. 19 the closed or collapsed orientation is illustrated there the central portion of each spring is bent almost into a complete circle in the hinge area, with the end portions lying parallel and next to each other.

Although only one spring is illustrated per hinge area, two or more can be used. Also the springs can have a width W of ½", ¾" or 1" or more, or less, depending on the force needed to open the insert in the expandable bag.

It will be appreciated that, while various aspects of the present invention have been shown in combination and in fact are preferably used together in a preferred embodiment, any one aspect of the present invention may be used in combination with conventional elements to also form a bag stuffer according to the present invention. Thus, the heat-sealable restraining means may be used in conjunction with conventional insert and biasing means, the techniques for securing the biasing means and the insert planar elements together may be used in conjunction with conventional restraining means, biasing means and inserts, and the compound assembly formed from a plurality of elemental assemblies may be used in connection with conventional restraining means, biasing means and insert means.

It is contemplated that commercially the bag stuffer according to the present invention will be manufactured separately from the expandable bag with which it is used. The bag stuffer will be manufactured and sold in the closed orientation, that is with the insert in the collapsed orientation and the restraining means being disposed thereabout to retain the insert in the collapsed orientation against the influence of the biasing means. In the case of bag stuffers with compound assemblies formed of a plurality of elemental assemblies, a single restraining means is preferably disposed about the entire compound assembly. The stuffer is sold and delivered as a complete assembly ready for use and not requiring any assembly by the user.

To summarize, the present invention provides a bag stuffer which, in selected preferred embodiments, is safe to use, simple and inexpensive to manufacture and deploy, and easily modifiable to vary the strength required to rupture or deactivate the restraining means and thereby to actuate the insert. The ends of the biasing means are directly secured to the planar elements of the insert at the hinge areas. The biasing means can be effected even without use of a separate spring and without expensive and/or complex mechanisms. The bag stuffer may have a biasing means which moves the planar elements supporting the bag to a desired separation greater than the length of the biasing means without the presence of intermediate elements such as flaps. The stuffer is useful with non-rectangular bags as well as rectangular bags.

Figure 20:
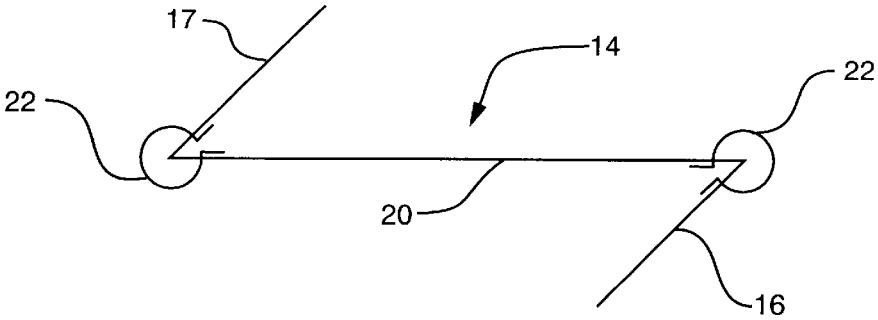
FIG. 20 is a schematic side elevational view of another embodiment of the invention where the side panels are folded to opposite sides of the bottom panel to form a Z-shaped insert.
Figure 21:
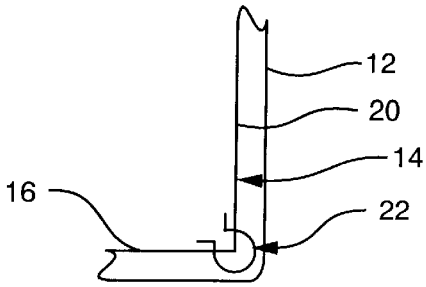
FIG. 21 is a side elevational view of another embodiment of the invention utilizing a bottom panel and only a single side panel which is useful for stuffing certain types of soft bags.

FIG. 20 illustrates another embodiment of the invention which uses flat leaf springs 22 as the biasing means, but which can also use torsion springs or any other type of biasing means at the hinges between the central bottom panel 20 and opposite side panels 16, 17. In FIG. 20, it is shown how the side panels can be folded to opposite sides of the bottom panel 20 to produce a Z-shaped insert when it is expanded for stuffing soft bags. FIG. 21 shows an embodiment of the invention where bottom panel 20 includes a single side panel 16 connected at a fold and biased by spring 22 into its expanded or open L-shaped orientation for a soft bag 12 having a generally triangular shape. The two paneled embodiment of FIG. 21 can also be used for other soft bag types.

While specific embodiments of the invention have been shown and described in detail to illustrate the application of the principles of the invention, it will be understood that the invention may be embodied otherwise without departing from such principles.

What is claimed is:

1. A storage bag combination comprising:

a flexible storage bag having at least one side wall and a bottom wall, the bag having a collapsed position and an expanded position;

an insert inside said bag, said insert being movable from a collapsed position inside said bag when said bag is in its collapsed position for enabling compact storage of said bag, to an expanded position inside said bag when said bag is in its expanded position for providing a commercial display of said expanded bag, said insert comprising at least one substantially rigid and substantially planar side panel for laying against said bag side wall when said bag is in its expanded position, and a bottom panel for laying against said bag bottom wall, said side panel being connected to one end of said bottom panel at a hinge formed by a fold between said side panel and said bottom panel, said hinge fold having an outside and an inside; and a spring for biasing said insert toward said expanded position, said spring comprising a leaf spring, said leaf spring having a central U-shaped portion lying on the outside of said hinge fold with a flat surface of said leaf spring facing the fold, said leaf spring having a pair of end portions on opposite sides of the central portion, each end portion extending through an opening in a panel and being on the inside of the hinge fold.

2. The combination of claim 1, including a second side panel connected at a second hinge to an opposite end of said bottom panel.

3. The combination of claim 1, wherein said side panel and said bottom panel are made of plastic sheet material, the fold at said hinge comprising a resilient live hinge.

4. The combination of claim 1, including releasable restraining means disposed about said bag and insert with said bag in its collapsed position, for restraining movement of said insert from said collapsed position to said expanded position under biasing of said leaf spring.

* * * * *